US005797542A

United States Patent [19]

O'Connor

[11] Patent Number: 5,797,542

[45] Date of Patent: Aug. 25, 1998

[54] LONGITUDINALLY-OPENING TUBULAR CONTAINER HAVING SPLIT END CAPS

[76] Inventor: Fiona O'Connor, 111 E. 88th St., New York, N.Y. 10128

[21] Appl. No.: 724,446

[22] Filed: Oct. 1, 1996

[51] Int. Cl.[6] ..... B65D 3/04; B65D 5/12; B65D 5/66

[52] U.S. Cl. ..... 229/109; 220/4.22; 220/4.23; 229/23 R; 229/110; 229/115; 229/125.08; 229/125.11

[58] Field of Search ..... 220/4.22, 4.23; 229/125.08, 125.11, 146, 108, 109, 110, 23 R, 115

[56] References Cited

U.S. PATENT DOCUMENTS

| | | | |
|---|---|---|---|
| 585,463 | 6/1897 | Doble | 229/125.11 |
| 1,560,884 | 11/1925 | Walter | 229/23 R |
| 1,892,714 | 1/1933 | Wellman . | |
| 2,186,973 | 1/1940 | Hothersall | 229/23 R |
| 3,261,533 | 7/1966 | Repking | 229/23 |
| 3,276,657 | 10/1966 | Speas | 229/5.7 |
| 4,019,674 | 4/1977 | Ikelheimer et al. | 229/23 R |
| 4,234,080 | 11/1980 | Gellert | 206/0.82 |
| 4,289,267 | 9/1981 | Mayea | 229/39 R |
| 4,482,074 | 11/1984 | Lalley | 229/23 R |
| 4,610,394 | 9/1986 | Bryson | 239/57 |
| 4,637,544 | 1/1987 | Quercetti | 229/23 R |
| 4,993,623 | 2/1991 | Kelly et al. | 229/110 |
| 5,169,014 | 12/1992 | Hexamer | 220/4.22 |
| 5,316,207 | 5/1994 | Ross | 229/109 |

*Primary Examiner*—Stephen P. Garbe
*Attorney, Agent, or Firm*—Cohen, Pontani, Lieberman, Pavane

[57] ABSTRACT

A longitudinally-opening container having a faceted tubular body is disclosed. The tubular body is formed by splitting a tube longitudinally, or from a single sheet of paperboard folded to form two end openings. End caps that cover each end opening are split in half along a central axis, forming sections having confronting edges along the median axis and bounded on either end by respective sections of the end caps. The container opens longitudinally into two trays connected by a living hinge. The living hinge is formed by a taped seam or a longitudinal fold in the body. The living hinge aligns the confronting edges to engage releasable locking means on those edges when the container closes. The locking means holds all the edges of the container in substantial alignment with each other.

23 Claims, 3 Drawing Sheets

LONGITUDINALLY-OPENING TUBULAR CONTAINER HAVING SPLIT END CAPS

BACKGROUND OF THE INVENTION

1. Field of the Invention

The present invention relates to tubular containers. More particularly, the present invention relates to tubular containers that open longitudinally into two sections.

2. Discussion of Related Art

Containers having a faceted tubular side wall formed from one or more paperboard blanks that are folded into a plurality of side and end panels are known in the art, as seen in U.S. Pat. No. 4,289,267. These containers are inexpensive to manufacture. They can easily accommodate a variety of size and shape objects by varying the length and number of sides and because they conform closely to cylindrical bottles and pack together readily, they make efficient use of the storage space available for their contents.

The faceted sides of these containers are also advantageous because they may be printed with colored graphics and/or text to make the container more attractive. Perfume and other products which rely on decorative and creative shaped packaging to sell the product have widely used such containers.

The containers formed from one-piece blanks often open longitudinally along a body of a container. However, tubular containers having separately formed end covers are usually opened by lifting a flap. Even one-piece blanks that open longitudinally do not split the end covers nor separate them from the body of the container WHEN opened longitudinally by lifting the flap.

U.S. Pat. No. 1,892,714 discloses a one-piece blank including four octagonal flaps that are assembled to form end walls as a fixed octagonal double-thickness tray structure at each end of the container. When this container's longitudinal tuck-in flap is opened, two of the octagons and half the container flatten out into a flap. The octagons on the remaining portion of the body preserve the outline of the faceted cylinder. Because, when the flap opens, the container body and end walls do not split in two, there is nothing to prevent a bottle contained therein from falling out when the container is opened improperly.

For example, if the container is opened while standing on end, the bottle will slide out of the body of the container with the inner octagonal flap that is attached to the flap. If the container is opened with the flap on the bottom, instead of on top of the container there is nothing to support the bottle. The four end walls are also duplicative and tricky to assemble.

If tubular containers are displayed standing on end, the end caps must be made from a material which is sturdy enough to bear weight and sufficiently securely attached to the side walls to assure the side-to-side stability of the stack.

SUMMARY OF THE INVENTION

The present invention provides an inexpensive, sturdy container which uses an easily printable paperboard blank, yet forms two complete half-body sections when opened longitudinally. The half-body sections prevent contents of the container from sliding out when the container is opened upside-down. The split halves of the end caps help stabilize a bottle held in the container, when the container is opened while standing on end. An inexpensive yet sturdy container is provided by a tubular body and two end caps. The tubular body has a longitudinal opening formed by longitudinal edges of the body and an opening perimeter at each end formed by side edges of the body. The opening at each end is closed by a respective end cap which separates into two sections along a central axis when the container is opened. The side edges may also be folded back on themselves along the opening perimeter to form side-edge flaps, thereby reinforcing the side edges and more securely attaching the endcaps to the body. The side-edge flaps are preferably folded and secured to the inside of the tubular body.

Preferably the tubular body is formed from a single sheet of foldable material. In a particular embodiment, the end caps are affixed to respective side edges of the body and the opposite longitudinal edges of the sheet meet the axis of each cap at said side edges.

In particular embodiments, a tab may be provided along the longitudinal side edges of the body to provide easy opening of the container. Locking means may also be provided. For instance opposing releasable locking elements may be provided on confronting edges along the central axis of one or more end caps. The end caps may divide the body into two trays connected along a single living hinge formed by a fold in said blank sheet and bounded on both ends by said end sections. The living hinge assures that the confronting edges of the sections of each end cap and the side edges of the body are substantially aligned with each other and the releasable locking means engage, when the container is closed.

In another particular embodiment the end caps may be made from injection-molded plastic. Grooves disposed for receiving and securing the end caps to the tubular body may be provided along the perimeter of each end cap. The use of molded end caps having grooves increases the strength of the end caps as well as the overall strength of the container.

BRIEF DESCRIPTION OF THE DRAWINGS

The features and advantages of the present invention will be better appreciated when the detailed description of presently preferred embodiments given below is considered in conjunction with the accompanying drawings, wherein.

In these drawings, like reference numerals are assigned to like structures.

DETAILED DESCRIPTION OF PREFERRED EMBODIMENTS

Figures 1, 2, 3, 4:
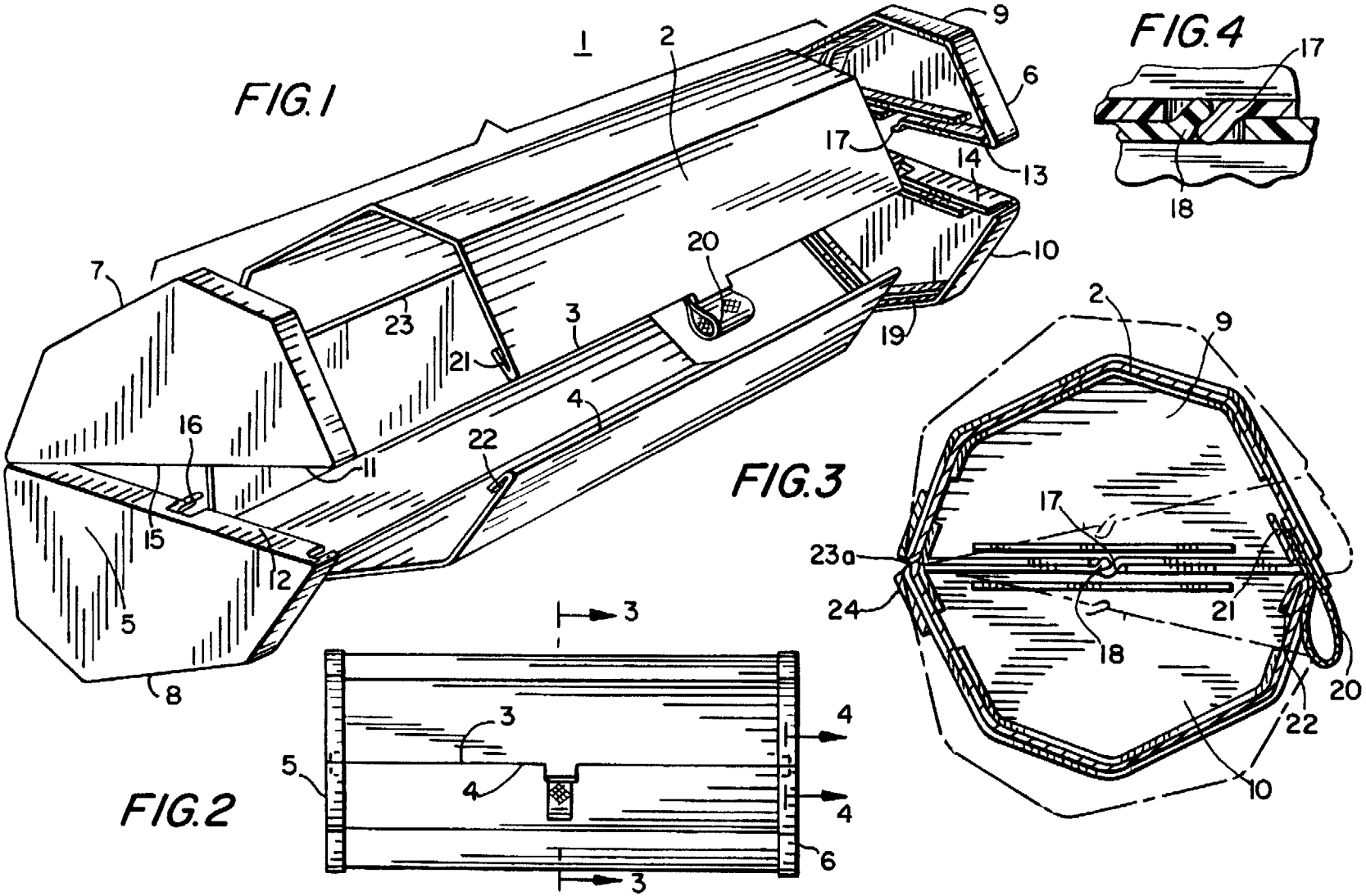
FIG. 1 is an exploded view of a partially opened 8-sided container in accordance with the present invention.
FIG. 2 is a planar view of the container of FIG. 1 in a closed state, as viewed from above.
FIG. 3 is a cross-section of the container shown in FIG. 2 taken along line 3—3.
FIG. 4 is a partial cross-section of the container shown in FIG. 2, taken along line 4—4.

In FIG. 1 the partially-opened 8-sided container 1 in accordance with the present invention is made from a single sheet of pasteboard 2 folded into an 8-sided tube. The sheet 2 is folded and the side edges 3 and 4 are brought together to form a tubular-shaped body with end openings at opposite ends. Non-rotatable end caps 5 and 6 are secured to the respective end openings of the tubular-shaped body, shown here as an exploded view of a partially- opened container.

Each end cap 5, 6 includes two end sections 7, 8 and 9, 10, respectively. Two end sections of each end cap split into two halves along the central axis. The central axis that divides each end cap also defines confronting edges 11, 12 and 13, 14 on each end cap section along the central axis of end sections 7, 8 and 9, 10, respectively.

The sheet may be made from any sturdy yet foldable material, including cardboard and plastic. The preferred material for the body is solid bleached sulphate paperboard approximately 0.024 inches (0.061 cm.) thick. Preferably the paperboard is die cut to form the body blank. Any desired graphics, sculptural effects or text may be printed onto the blank using any of the known suitable transfer means, including leaf or foil stamping and blind embossing.

In the preferred embodiment a polyurethane coating is applied to the foldable material. This coating provides a shiny finish that helps keep the surface clean. Other types of gloss coatings may be used.

The sheet 2 has two side edges 3 and 4. To make the side edges sturdier, each side edge is preferably folded onto itself, to form respective side-edge flaps. Each side-edge flap is preferably secured to the interior of the tubular-shaped body 2 using glue, but any known suitable adhesive or other securing means may be used.

FIG. 2 shows the container in FIG. 1 in its closed state with the side edges 3 and 4 substantially aligned, and end caps 5 and 6 enclosing the ends of the container. In the preferred embodiment, the end caps are made from injected molded plastic using techniques generally known to those skilled in the injection molding art. The end caps may be colored, printed or embossed to match the body of the container. The plastic end caps strengthen the container so that heavier objects can be stored.

In the preferred embodiment, as shown in FIG. 3, the end caps 5 and 6 are fitted onto the end openings within a groove 19 along the perimeter of each end cap, thereby further reducing the risk of the end caps becoming detached from the body of the container. Alternatively, the end caps may be made from the same foldable material used to make the tubular body.

Figure 5A:
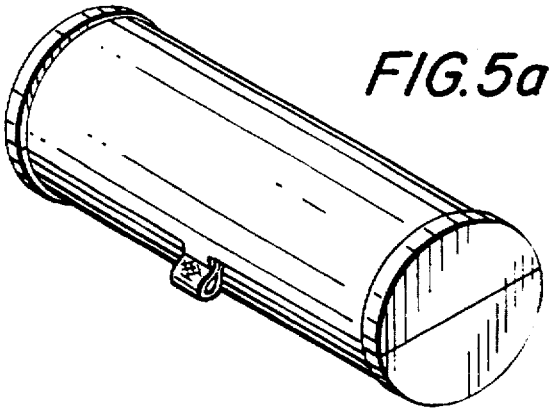
FIGS. 5*a–g* show other embodiments of the present invention.
Figure 5B:
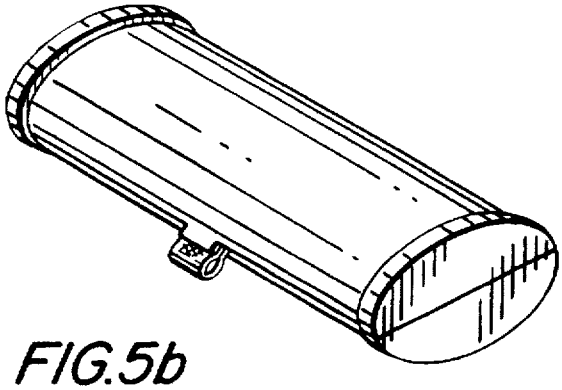
Figure 5C:
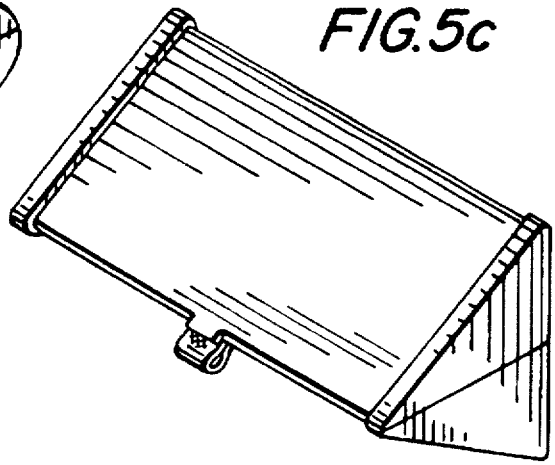
Figure 5D:
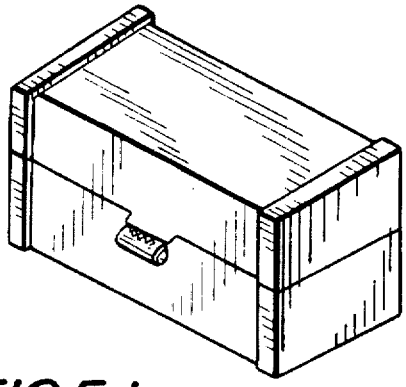
Figure 5E:
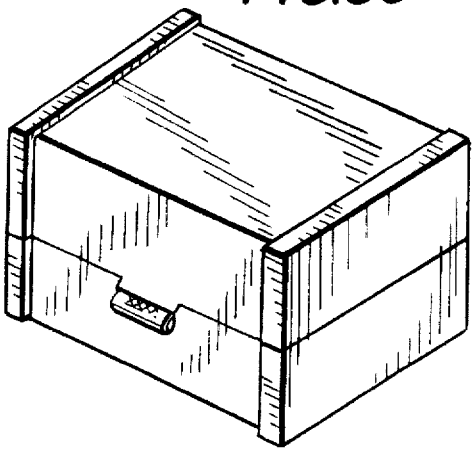
Figure 5F:
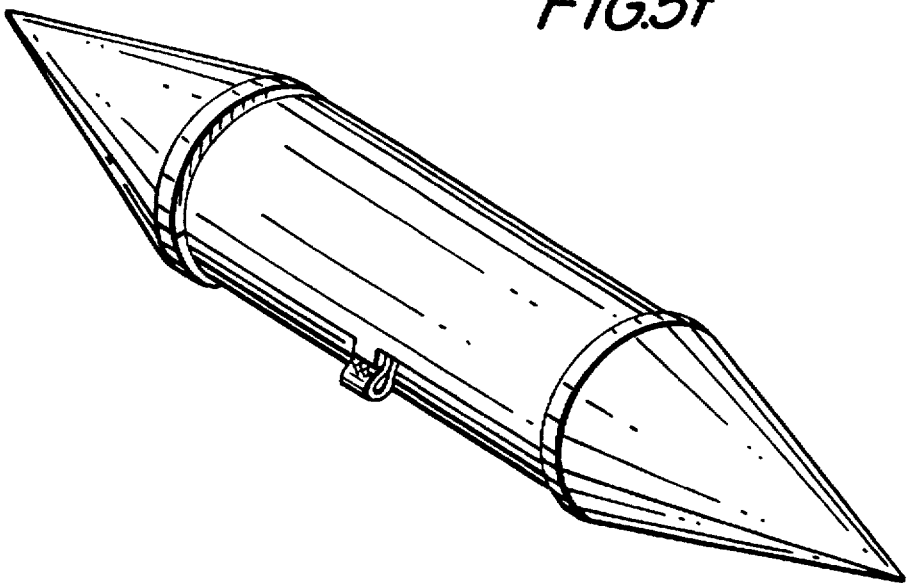
Figure 5G:
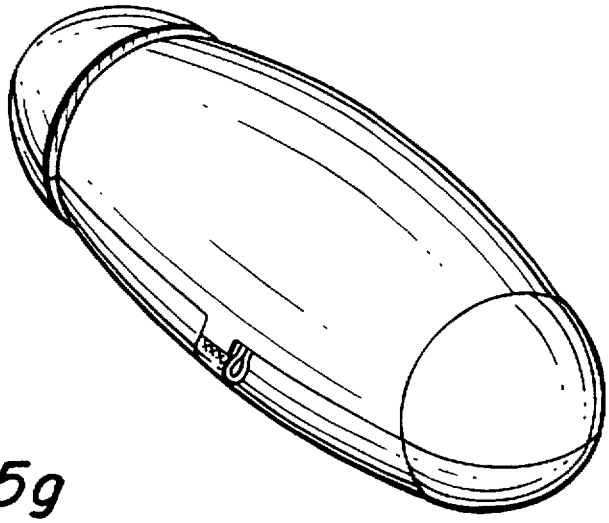

The cross section of the tubular body is defined by the size and shape of the end caps. The 8-sided container in FIG. 1 has octagonal end caps 5 and 6. In the closed state, the body of the container will have the octagonal cross section shown in FIG. 3. However the size and shape of the container is easily variable to accommodate contents having a wide variety of sizes and shapes. The end caps of the tubular body can be circular, oval, regular or irregular polygons, or curves or other complex forms, as shown in FIGS. 5*a–e*. The size and shape of the container is limited only by the size and shape of the sheet being used. Although the end caps 5 and 6 shown in FIGS. 1 and 2 are generally planar. Alternatively, the end caps may be three-dimensional, as shown in FIGS. 5*f* & *g*.

The container of the present invention also preferably includes releasable locking means along the confronting edges 11, 12, 13 and 14 of the end sections of each end cap. In the preferred embodiment of FIG. 1, complementary rib-and-socket connectors 15, 16, 17, 18 are positioned along respective confronting edges 11, 12, 13, 14. When the container is in a closed state, as shown in FIGS. 3 and 4, the complementary connectors 15, 16, 17 and 18 of the releasable locking means on the end caps 5, 6**, engage each other, holding the longitudinal side edges and the confronting edges along the central axis of each end cap in substantial alignment with each other.

Any suitable releasable connectors may be used. For example, upper and lower engagable lips, or strips of hook-and-loop material or synthetic material that adhere together when pressed may be also used as the releasable locking means, depending on the appearance, cost and resistance-to-opening desired.

Preferably the locking means are hidden between the confronting edges, as seen in FIG. 2, so that the locking means will not protrude from the end caps in a closed state. Thus these containers can either be stacked lengthwise or stood on either end cap. The locking means shown are molded as integral part of the end caps, but they may be manufactured separately and then secured or adhered to the container.

When opened, the tubular-shaped body of the container divides longitudinally into two trays connected along a fold in the body that defines a single living hinge 23, as shown in FIG. 3. Alternatively, the body 2 may be formed by splitting a pre-formed plastic or paperboard tube in half and rejoining the two pieces together by using a piece of tape 24 to form the living hinge 23*a*, if the tube is rigid. If the tube is sufficiently flexible and sturdy to provide an integral living hinge, it may be formed into a sheet by splitting the tube open along one side. For example, plastic tubing may be split along one side and its longitudinal edges folded back upon themselves and heat-sealed to reinforce the opening. Such tubes may have a circular, oval, or regular or irregular polygonal, curved or complex form in its cross section.

Each tray in FIG. 1 is bounded by respective end sections. The top tray is bounded by end sections 7 and 9. The bottom tray is bounded by end sections 8 and 10. The respective end sections affixed to each half of the container support the prevent the contents of the container from falling out when the container is opened improperly.

The container in FIG. 1 also has a pull tab 20 along one of the side edges 3 and 4 of the tubular body, to assist in opening the container. Any type of known pull means may be used depending on the desired use of the container. Pull means may be positioned anywhere along either or both side edges 3, 4.

Preferably a ribbon pull is attached to the tubular body as shown in FIG. 3. The ribbon 20 is partially inserted through an aperture in one of the side edge flaps 21, 22, leaving enough ribbon protruding from the side edge to be grasped and pulled. To reduce the chance that the ribbon pull will become detached from the container, the ribbon pull is inserted through the side edge flap 21, 22 before securing the side edge flap to the interior of the tubular body. However, stapling or any other suitable means for securing or adhering the pull tab may be used.

The container may be manually opened, with or without the help of the pull means, by grasping each half of the container in each hand and separating the two side edges of the tubular-shaped body to release the locking means on the confronting edges of the end cap at each end of the container.

The container may be closed by once again grasping the container and closing the side edges until the complementary connectors comprising the releasable locking means on both sides of the container are engaged. As illustrated by FIGS. 2 through 4, when the assembled container is in a closed state, the complementary connectors of the releasable locking means engage causing the side edges and the confronting edges of the end sections of each end cap respectively to be substantially aligned.

The invention has been described with particular reference to a presently-preferred embodiment thereof. However, it will be immediately apparent to one skilled in the art that variations and modifications are possible within the spirit and scope of this invention. The invention is defined by the claims appended below.

I claim:

1. A tubular container, said container comprising:

a sheet of material having two side edges, said sheet forming a tubular body having a longitudinal opening having two longitudinal edges and two end openings having two perimeter edges;

two end caps, each end cap having a perimeter, said end caps being secured to said end openings; and a central axis on each end cap, said end caps being split along said central axis so as to form respective end cap sections, said end-cap sections having confronting edges along said central axis, whereby the tubular body is longitudinally divided into two trays connected by a living hinge, each tray being bounded by respective end sections.

2. The container of claim 1, wherein said sheet is formed by die-cutting a flat material.

3. The container of claim 1, wherein said sheet is formed by cutting a tubular material lengthwise.

4. The container of claim 3, wherein said sheet is formed by cutting said tubular material lengthwise into two sections along each end of a diameter of said tubular material and rejoining said sections by attaching a flexible material along a longitudinal edge of each respective section.

5. The container of claim 2, wherein the sheet is a foldable paperboard blank coated with polyurethane.

6. The container of claim 1, wherein said end caps are made from the same material used to form the tubular body.

7. The container of claim 1, wherein said end caps are made from molded plastic.

8. The container of claim 7, wherein grooves are disposed along the perimeter of said end caps for receiving and securing said end caps to said end openings.

9. The container of claim 1, wherein said end caps are triangular.

10. The container of claim 1, wherein said end caps are oval.

11. The container of claim 1, wherein said end caps are circular.

12. The container of claim 1, wherein said end caps are curved.

13. The container of claim 1, wherein said end caps are polygons.

14. The container of claim 1, further comprising:

releasable locking means disposed along the confronting edges of the end sections of each end cap so as to hold the confronting edges of each end cap and the side edges of the longitudinal opening in substantial alignment with each other, respectively.

15. The container of claim 14, wherein the end caps are made from molded plastic and said releasable locking means is integral with the molded end caps.

16. The container of claim 14, wherein said releasable locking means is hidden between the confronting edges of the end sections of each end cap.

17. The container of claim 14, wherein said releasable locking means includes rib-and-socket connectors.

18. The container of claim 1, wherein each of the side edges is folded over onto itself so as to form a respective side-edge flap, said side-edge flap being secured within the tubular body to provide strength along said side edges.

19. The container of claim 1, further comprising pull means for opening and closing the container, said pull means being secured to one of said side edges.

20. The container of claim 19, wherein said pull means is inserted in at least one of the side edge flaps so that the ribbon pull protrudes from the corresponding side edge.

21. The container of claim 1, wherein said end caps are three-dimensional.

22. The container of claim 21, wherein said end caps are hemispherical.

23. The container of claim 21, wherein said end caps are conical.

* * * * *